US006819030B2

(12) United States Patent
Lipp et al.

(10) Patent No.: US 6,819,030 B2
(45) Date of Patent: Nov. 16, 2004

(54) SPARK PLUG

(75) Inventors: Hans-Joerg Lipp, Farmington Hills, MI (US); Simon Schmittinger, Renningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/407,306

(22) Filed: Apr. 4, 2003

(65) Prior Publication Data

US 2003/0214210 A1 Nov. 20, 2003

(30) Foreign Application Priority Data

Apr. 9, 2002 (DE) ..... 102 15 625

(51) Int. Cl.[7] ..... H01T 13/00
(52) U.S. Cl. ..... 313/118; 313/141; 313/143
(58) Field of Search ..... 313/118, 141, 313/143

(56) References Cited

U.S. PATENT DOCUMENTS 6,170,451 B1 1/2001 Moriya

FOREIGN PATENT DOCUMENTS

| | | |
|---|---|---|
| DE | 44 09 412 | 9/1994 |
| DE | 196 36 537 | 3/1998 |
| DE | 198 29 443 | 1/2000 |
| EP | 0 101 547 | 2/1984 |
| JP | 11 273 827 | 10/1999 |

*Primary Examiner*—Vip Patel
(74) *Attorney, Agent, or Firm*—Kenyon & Kenyon

(57) ABSTRACT

A spark plug includes a shell on which a threaded shank having a thread and a tool attachment for installation in an internal combustion engine are situated, and an assembly shank of the shell running between the threaded shank and the tool attachment. The spark plug is dimensioned in such a way that the ratio of the sum of the threaded shank length and the assembly shank length to the sum of the assembly shank diameter and the thread diameter is between 0.95 and 1.55.

13 Claims, 3 Drawing Sheets

SPARK PLUG

BACKGROUND INFORMATION

A spark plug is known from European Patent No. 0 101 547 and is designed for use in a gasoline engine.

The known spark plug includes an essentially tube-shaped, metallic shell which has a thread for mounting into the cylinder head of the engine, as well as a hexagonal surface as a means for assembly into the engine. The shell has a through bore in which an essentially rotationally symmetric electrical insulator is situated, a center electrode being fixedly attached to it; the center electrode cooperates with a ground electrode which is situated at the end section of the shell on the combustion chamber side.

In the assembled state, the end section of the shell, i.e., the spark plug, protrudes into the combustion chamber on the combustion chamber side.

In practice it is important to design internal combustion engines so that their fuel consumption and emission levels are low. In this connection it is also important to cool the engine in order to achieve high thermal efficiency, which takes place via cooling ducts. In order to dimension the cooling ducts sufficiently generously, the spark plugs installed in the cylinder head of the engine are only to be allowed a limited space.

However, this is not achievable using contemporary spark plugs without the mechanical and electrical characteristics of the spark plugs being changed in an adverse manner.

SUMMARY OF THE INVENTION

The spark plug according to the present invention has the advantage over the related art that it is optimized with regard to the space required for installation, so that the space required for installing the spark plug is small, and larger cooling ducts, exhaust ports, and intake ports in the cylinder head may be implemented, in particular in the region of the sealing seat compared to the related art. This makes possible a thermodynamically favorable combustion with simultaneously high performance of the engine, since the cylinder head may be provided with comparatively large cooling ducts and large exhaust valves and intake valves.

In order to lower the operating temperature and the natural vibration of the ground electrode compared to conventional spark plugs, a spark plug having length/diameter ratios according to the present invention is provided with a very long thread, i.e., a type of thread extension which is an integral part of the threaded shank. As a rule, the thread is an integral part of a plug shell which accommodates what is known as a plug stopper.

The dimensions of the spark plug according to the present invention are such that, compared to a spark plug according to the related art, this spark plug, despite the reduced assembly space achieved, meets all requirements of a modern spark plug, including, for example, adequate breakdown resistance and twist-off resistance.

A projected spark position reaching well into the combustion chamber of the engine may also be implemented in a spark plug according to the present invention, without the danger of a vibration breakdown of the ground electrode and without the temperatures affecting the spark plug reaching a value above the permissible level for the material used. The spark plug is therefore suitable in particular for application in fuel injector systems.

The spark plug according to the present invention may in particular be designed such that the ratio of the sum of the length of the threaded shank and the length of the assembly shank to the sum of the diameter of the assembly shank and the diameter of the thread for a thread diameter of 12 mm and a length of the threaded shank of between 19 mm and 22 mm assumes a value between 1.08 and 1.20, or it assumes a value between 1.2 and 1.50 for a threaded shank length of between 25 mm and 29 mm, or a value of between 0.94 and 1.05 for a threaded shank length of between 17.5 mm and 22 mm.

The spark plug according to the present invention advantageously has a conical sealing seat in order to achieve accurate positioning of the ground electrode in the combustion chamber of the engine. The conical sealing seat is preferably positioned in the transition area between the threaded shank and the assembly shank.

An assembly shank is considered optimized in terms of assembly space, for example, when the ratio between the assembly shank diameter and the assembly shank length is less than 1.30, or greater than 1.70, i.e., for example 1.26 or 1.72.

The spark plug according to the present invention is advantageously provided with a marking in order to achieve an accurate alignment of the ground electrode in the combustion chamber with small tolerances. The marking, for example, may be a mark on the double hexagon used as assembly means. The mark may be a marking on a connecting nut or a connecting bolt, such as a bore, an indentation, or a color speck; but it may also be a colored marking on the electrical insulator.

Furthermore, it is advantageous for optimal mounting of the plug stopper of the spark plug in the spark plug shell if a compressed powder pack is situated in an annular gap between the plug stopper and the plug shell. In order to produce the powder pack, using talcum for example, the appropriate powder is poured into the gap between the plug stopper and the plug shell during assembly of the spark plug and compressed. During final assembly of the spark plug, a rim of the plug shell is deformed radially in the direction of the plug stopper. The rim of the shell compresses the powder pack, whereby the stopper is mounted in the shell.

In order to optimize the powder pack compression, the powder pack may, at least on one side in the axial direction of the spark plug stopper, be limited by a pressure ring. In this case, during final assembly of the spark plug, the rim is also deformed radially in the direction of the plug stopper, so that the powder pack is compressed by both the rim and the ring. By compressing the powder pack in this way, the plug stopper is mounted in the plug shell, ensuring a high degree of heat insulation.

A particularly good powder pack compression and the associated heat insulation of the spark plug may be achieved if the powder pack is limited by a pressure ring on both sides.

DETAILED DESCRIPTION

Figure 1:
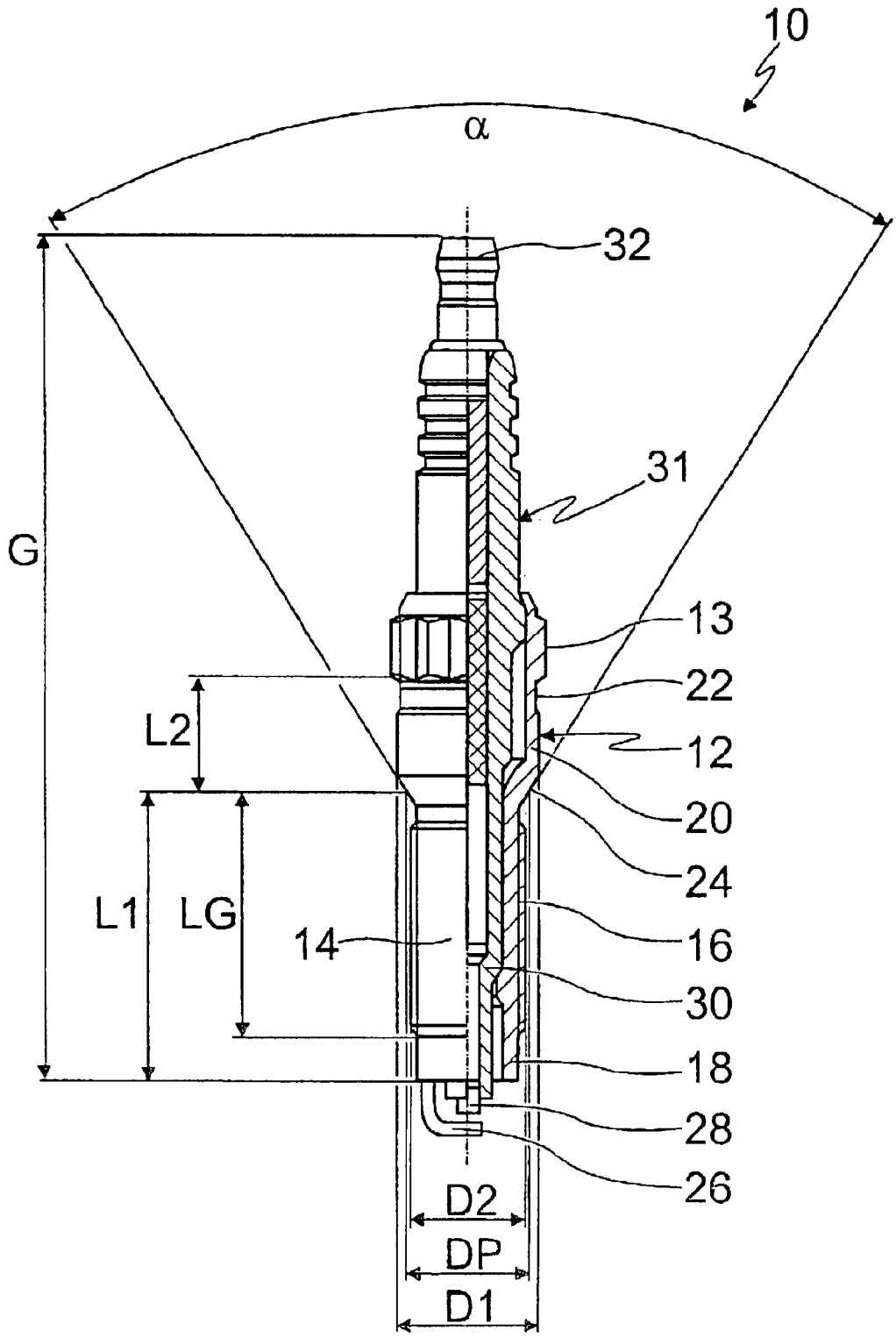
FIG. 1 shows a schematic illustration of a first embodiment of a spark plug according to the present invention in a partial section.

FIG. 1 shows a spark plug 10 which is designed for assembly in an internal combustion engine having direct gasoline injection. Spark plug 10 includes an essentially tube-shaped metallic shell 12, which has a tool attachment in the form of a double hexagon 13, as well as a threaded shank 14 for installation in a cylinder head of an internal combustion engine. Threaded shank 14 includes, schematically indicated in the drawing, a thread 16, here designed as a metric ISO thread, as well as a thread extension 18, which, on the combustion chamber side, is attached to thread 16 in the axial direction.

Between threaded shank 14 and double hexagon 13, shell 12 is provided with an essentially cylindrical assembly shank 20 which has a shrinking area 22 in the transition area to double hexagon 13, and which, in the installed state, is essentially embedded in the cylinder head.

In the transition area between threaded shank 14 and assembly shank 20, a conical sealing seat 24 is situated on the outside of shell 12; the sealing seat has a conical angle $\alpha$ of approximately 63° and ensures tightness of the combustion chamber in this area vis-a-vis the surroundings.

A ground electrode 26 is attached to metallic shell 12 at its combustion chamber side end; the ground electrode is designed in the usual manner and cooperates with a center electrode 28 as usual. The center electrode is fixedly attached to an electrical insulator 30 of a plug stopper 31 which is essentially made of aluminum oxide in the present embodiment, and which protrudes through shell 12 in the axial direction, and to which a terminal contact 32 is attached at the end facing away from center electrode 28.

In the embodiment shown, spark plug 10 has a total assembly length G of 84.9 mm, from the combustion chamber-side face of shell 12 to the terminal-side face of terminal 32. Assembly shank 20 has a diameter D1 of 14.5 mm and thread 16 has a nominal diameter D2 of 12 mm. Moreover, spark plug 10 has a test diameter DP of 12.8 mm which lies in the area of conical sealing seat 24.

In the present embodiment, threaded shank 14 has an assembly length L1 of 29 mm which extends from the face of thread extension 18 to the position of test diameter DP at conical sealing seat 24. It has been found in studies that, in spark plugs having comparable dimensions, a threaded shank length of more than 25 mm is advantageous for achieving the intended length/diameter ratio. Thread 16 extends here up to a length LG of 24.3 mm, measured from the position of test diameter DP to conical sealing seat 24.

Assembly shank 20 has a length L2 of 11.4 mm, measured from the position of test diameter DP at conical sealing seat 24 to double hexagon 13.

The ratio of the sum of threaded shank length L1 and assembly shank length L2 to the sum of assembly shank diameter D1 and threaded shank diameter D2 amounts to 1.53 in the present exemplary embodiment; thus it is greater than a determined critical value of 1.38.

Using the dimensions shown, spark plug 10 optimizes the spark position and implements an optimal thread length for reducing the space required for installation.

Figure 2:
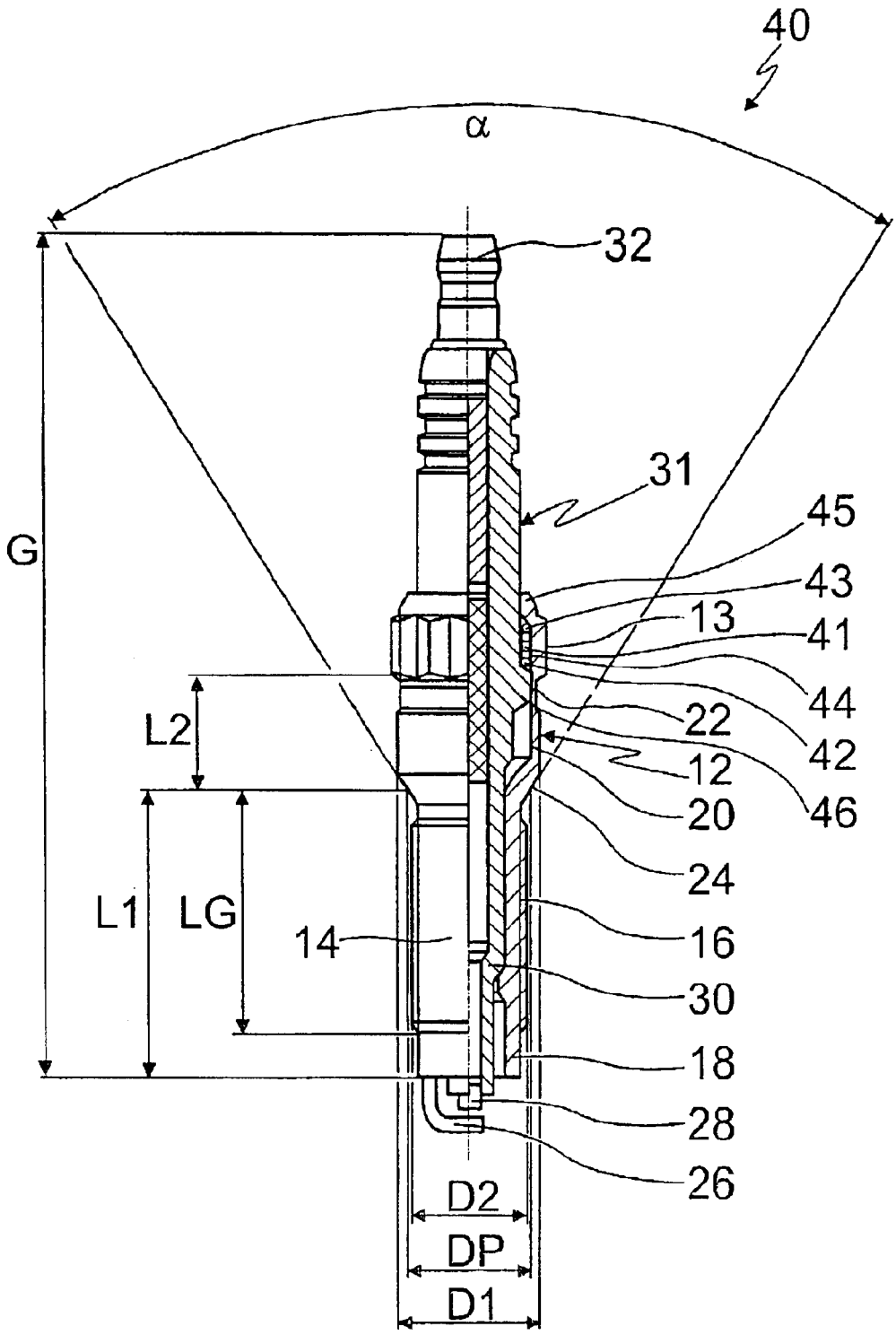
FIG. 2 shows a schematic illustration of a second embodiment of a spark plug according to the present invention in a partial section.

A further embodiment of a spark plug 40 according to the present invention is illustrated in FIG. 2. Spark plug 40 differs from the one in FIG. 1 in that threaded shank 14 has an assembly length L1 of 20 mm. Assembly shank 20 also has a length L2 of 11.4 mm and a diameter D1 of 14.5 mm in this exemplary embodiment. Thread 16 of threaded shank 14 also has a nominal diameter D2 of 12 mm.

The ratio of the sum of threaded shank length L1 and assembly shank length L2 to the sum of assembly shank diameter D1 and threaded shank diameter D2 thus amounts to 1.18 in the present exemplary embodiment.

Moreover, spark plug 40 differs from the one in FIG. 1 in that a powder pack 41 composed of talcum is situated in an annular gap 44, which in turn is situated between plug shell 12 and plug stopper 31, the powder pack being limited in the axial direction of plug stopper 31 by a first pressure ring 42 and a second pressure ring 43. First pressure ring 42 adjoins an annular collar 46 of plug stopper 31. Second pressure ring 43 adjoins a rim 45 of shell 12 which is radially deformed in the direction of plug stopper 31.

Figure 3:
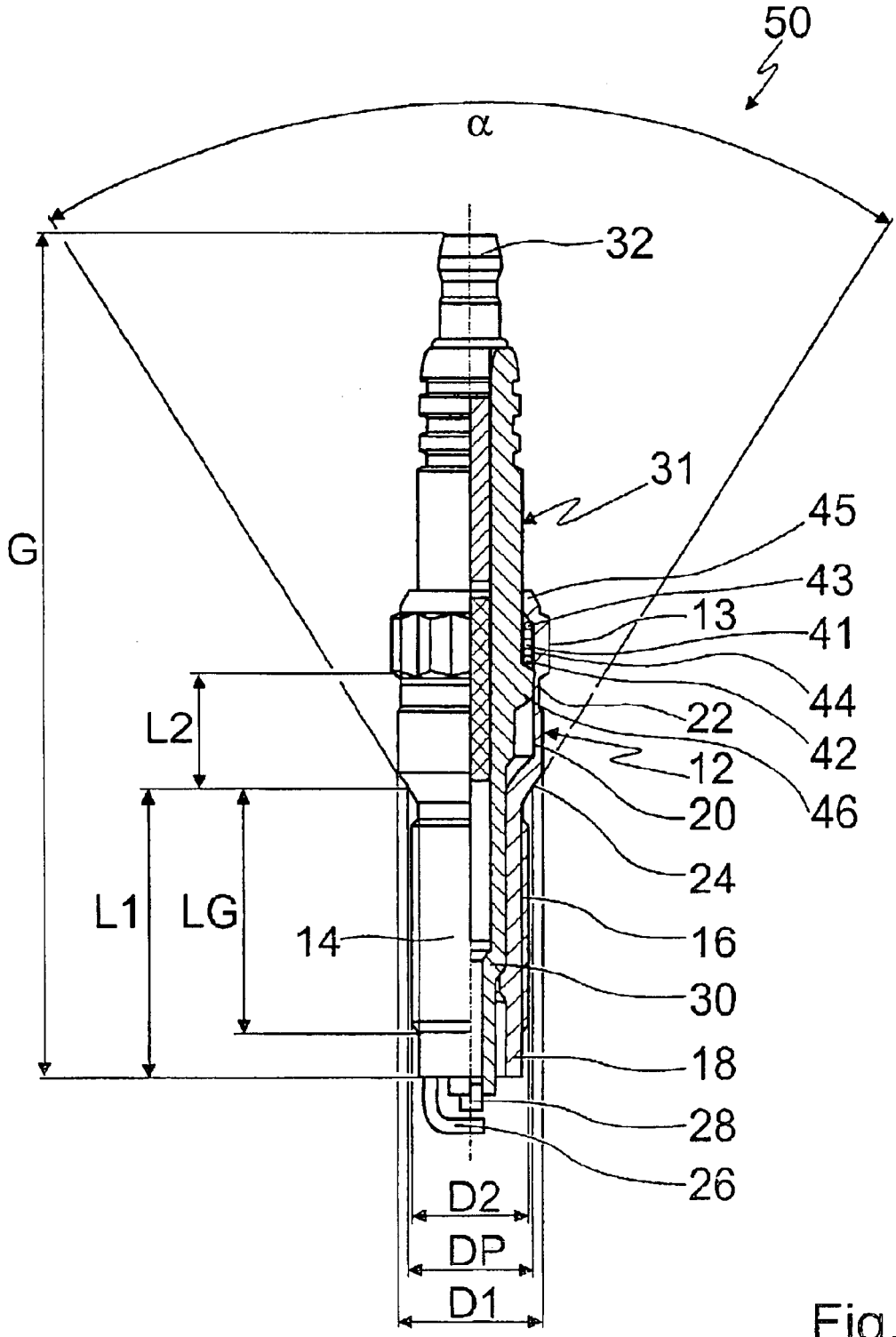
FIG. 3 shows a schematic illustration of a third embodiment of a spark plug according to the present invention in a partial section.

A further embodiment of a spark plug 50 according to the present invention is illustrated in FIG. 3. Spark plug 50 differs from the spark plug according to FIG. 2 in that threaded shank 14 has an assembly length L1 of 25 mm. Assembly shank 20 has a length L2 of 8.6 mm and a diameter D1 of 15.54 mm. Thread 16 of threaded shank 14 also has a nominal diameter D2 of 12 mm.

The ratio of the sum of threaded shank length L1 and assembly shank length L2 to the sum of assembly shank diameter D1 and threaded shank diameter D2 thus amounts to 1.22 in the present exemplary embodiment.

What is claimed is:

1. A spark plug comprising:

a threaded shank having a thread;

a tool attachment; and a shell on which the threaded shank and the tool attachment for installation in an internal combustion engine are situated, the shell including an assembly shank running between the threaded shank and the tool attachment, wherein the threaded shank has a length, wherein the thread has a diameter, wherein the assembly shank has a length and a diameter, and wherein a ratio of (a) a sum of the length of the threaded shank and the length of the assembly shank to (b) a sum of the diameter of the assembly shank and the diameter of the thread is between 0.95 and 1.55.

2. The spark plug according to claim 1, wherein the diameter of the thread is 12 mm, the length of the threaded shank is between 19 mm and 22 mm, and the ratio has a value between 1.08 and 1.20.

3. The spark plug according to claim 1, wherein the diameter of the thread is 12 mm, the length of the threaded shank is between 25 mm and 29 mm, and the ratio has a value between 1.20 and 1.50.

4. The spark plug according to claim 1, wherein the diameter of the thread is 12 mm, the length of the threaded shank is between 17.5 mm and 22 mm, and the ratio has a value between 0.95 and 1.05.

5. The spark plug according to claim 1, wherein the diameter of the assembly shank is 15.54 mm.

6. The spark plug according to claim 1, wherein the diameter of the assembly shank is 14.5 mm.

7. A spark plug comprising:

a threaded shank having a thread;

a tool attachment; and a shell on which the threaded shank and the tool attachment for installation in an internal combustion engine are situated, the shell including an assembly shank running between the threaded shank and the tool attachment, wherein the threaded shank has a length, wherein the thread has a diameter, wherein the assembly shank has a length and a diameter, and wherein a ratio of (a) a sum of the length of the threaded shank and the length of the assembly shank to (b) a sum of the diameter of the assembly shank and the diameter of the thread is at least as high as 1.38.

8. The spark plug according to claim 7, wherein the length of the threaded shank is greater than 25 mm.

9. The spark plug according to claim 7, wherein:

the length of the threaded shank is 29 mm, the length of the assembly shank is 11.5 mm, the diameter of the assembly shank is 14.5 mm, and the diameter of the thread is 12 mm.

10. The spark plug according to claim 7, wherein the shell has a conical sealing seat.

11. The spark plug according to claim 7, further comprising:

a ground electrode; and a marking for positioning of the ground electrode.

12. The spark plug according to claim 7, further comprising:

a plug stopper; and a compressed powder pack for holding the plug stopper in the shell, the powder pack being situated between the shell and the plug stopper reaching through the shell.

13. The spark plug according to claim 12, further comprising a pressure ring for limiting the powder pack in an axial direction of the plug stopper, at least on one side.

* * * * *